US006116931A

United States Patent [19]

McCleerey et al.

[11] Patent Number: 6,116,931

[45] Date of Patent: Sep. 12, 2000

[54] CONTACT ARRAY FOR ELECTRICAL INTERFACE CONNECTOR

[75] Inventors: Earl William McCleerey, Mechanicsburg; Michael Eugene Shirk, Grantville, both of Pa.

[73] Assignee: The Whitaker Corporation, Wilmington, Del.

[21] Appl. No.: 09/170,632

[22] Filed: Oct. 13, 1998

Related U.S. Application Data

[60] Provisional application No. 60/065,272, Nov. 10, 1997.

[51] Int. Cl.[7] ..... H01R 29/00

[52] U.S. Cl. ..... 439/173; 439/891; 439/651

[58] Field of Search ..... 439/170–175, 439/891, 651

[56] References Cited

U.S. PATENT DOCUMENTS

| | | | |
|---|---|---|---|
| 1,530,011 | 3/1925 | Pacent | 439/655 |
| 1,956,379 | 4/1934 | Douglas | 439/720 |
| 1,986,269 | 1/1935 | Jermain | 439/651 |
| 2,526,325 | 10/1950 | Burtt et al. | 439/690 |
| 3,140,139 | 7/1964 | Urban | 439/686 |
| 4,085,996 | 4/1978 | Koslo | 439/105 |
| 4,458,970 | 7/1984 | Fourreau et al. | 439/891 |
| 4,519,666 | 5/1985 | Williams et al. | 439/891 |
| 5,295,845 | 3/1994 | Changxing | 439/171 |

FOREIGN PATENT DOCUMENTS

| | | | |
|---|---|---|---|
| 24318 | 12/1950 | Finland | 439/652 |
| 562591 | 5/1957 | Italy | 439/173 |

OTHER PUBLICATIONS

U.S. applicationl No. 09/056,083, filed Apr. 7, 1998 (Abstract and drawings only).

*Primary Examiner*—Neil Abrams
*Attorney, Agent, or Firm*—Michael Aronoff

[57] ABSTRACT

Interface modules (200,300) have identical first mating interfaces (204,304) to mate with the same cable tap connector (10). Contact arrays for either of the two different interface modules (200,300) are defined by use of the same first members (232) having first contact sections (224,322) and transverse body sections (228,324), being joined to one of two groups (226) or (336) of socket members by crimping pin embossments (242) or (338) at either closely spaced holes (248) or less closely spaced holes (250), to define a closely spaced array (254) or a less closely spaced array (258) along second mating interfaces (206,306) to correspond with smaller round cable connector (208) or larger round cable connector (308). Thereby a cable tap connector (10) providing connection to a flat cable (12) may be modified by selection of different interface modules (200) or (300) for use with different types of mating connectors (208) or (308) The contacts of each array may also be of different sizes.

3 Claims, 9 Drawing Sheets

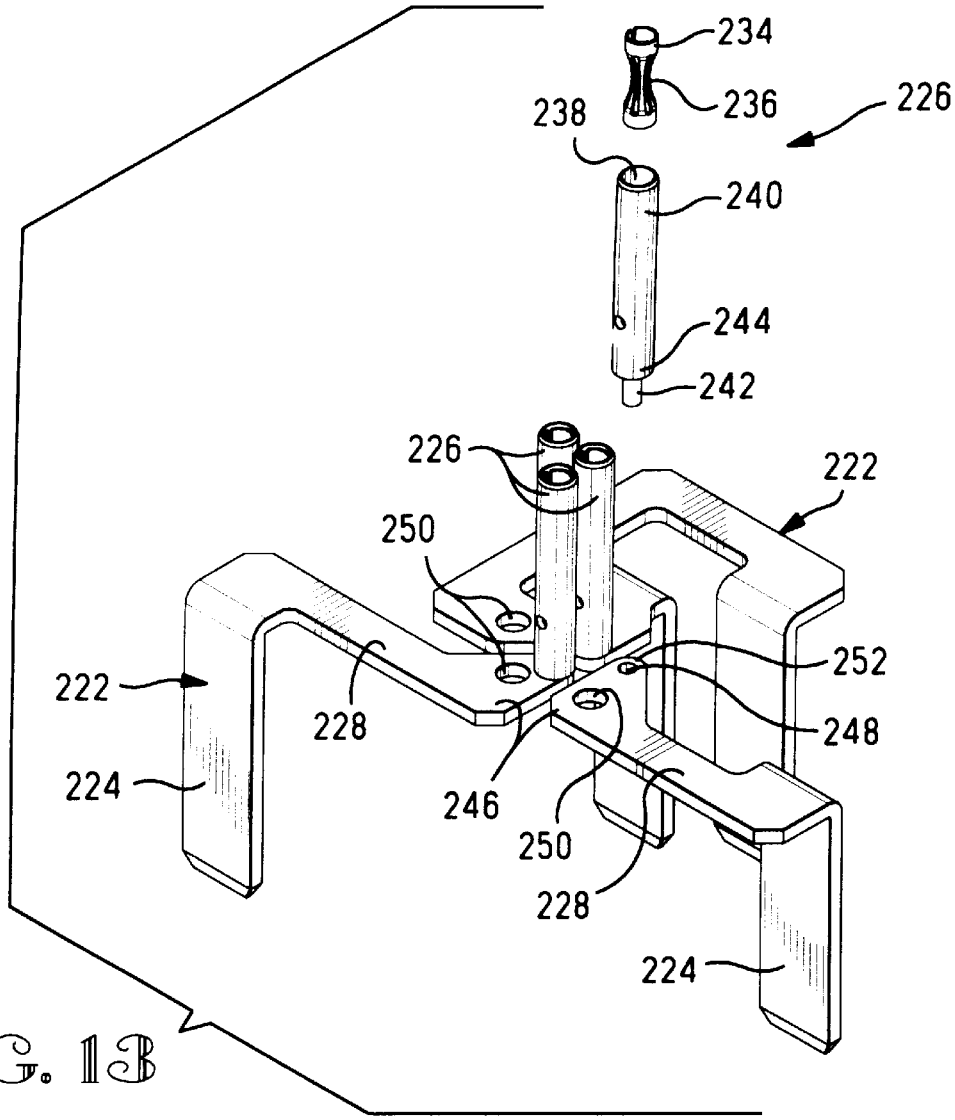
FIG. 13
FIG. 14
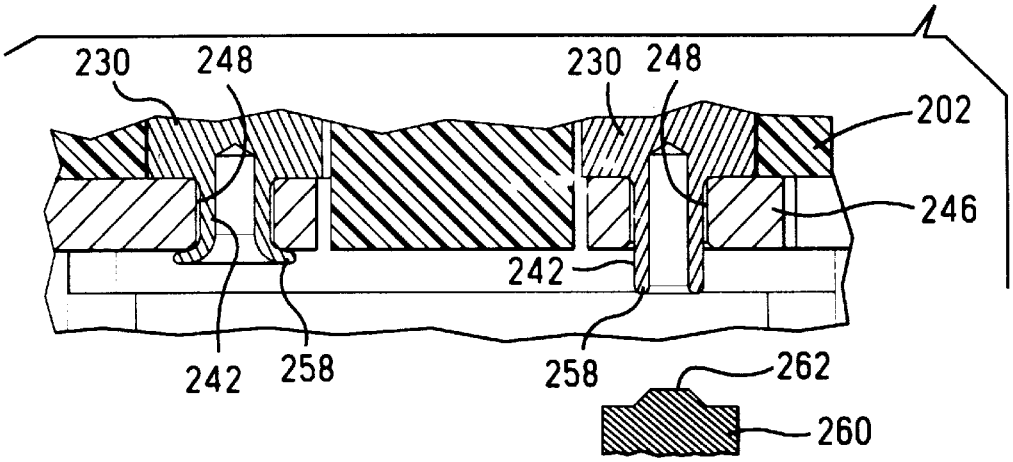

CONTACT ARRAY FOR ELECTRICAL INTERFACE CONNECTOR

This application claims the benefit of U.S. Provisional Application(s) No(s). 60/065,272, filed Nov. 10, 1997.

FIELD OF THE INVENTION

This relates to the field of electrical connectors and more particularly to connectors for establishing a tap connection to multiconductor cable.

BACKGROUND OF THE INVENTION

For establishing taps to cables such as heavily jacketed cables having a plurality of conductors for transmission of electrical power, especially direct current power, or transmission of both power and signals, it is desired to provide an interface connector that mates with a cable tap connector applied to the cable and allows for mating by a conventional round cable connector.

It is further desired to provide a contact array that enables mating with the cable tap connector and also with at least two different sizes of conventional round cable connectors when utilized in two different interface connectors.

SUMMARY OF THE INVENTION

The contact array provides a plurality of similar contacts that after being affixed in the housing of the interface module, together will enable mating with the contacts of the cable tap connector along a first mating face of the interface module, and mating with the contacts of the round cable connector along an opposed second mating face of the module. Each contact includes a first member that defines a transverse body section and a first contact section, and a second member that defines a second contact section and is adapted to be joined to the first member body section at a selected one of a plurality of locations.

More specifically, each first member body section provides at least two joining portions each adapted to cooperate with a complementary joining portion of the second member at an end opposed to the second contact section. When the contacts are assembled into the housing, the second contact sections are so located along the second mating face of the module corresponding to the particular joining portions of their respective first member body sections. The second contact sections can define a closely spaced conventional mating interface or at least one more widely spaced conventional mating interface as desired, while the first mating face is identical in all cases and the contacts may be secured in the module in the same manner.

An embodiment of the present invention will now be described by way of example with reference to the drawings.

BRIEF DESCRIPTION OF THE DRAWINGS

FIG. 13 is an isometric view similar to FIG. 11 showing a first member of a terminal and a second member being assembled thereto;

FIG. 14 is an enlarged cross-sectional view showing a second terminal member being affixed to a first terminal member of the invention.

DETAILED DESCRIPTION OF THE EMBODIMENTS

Figure 1:
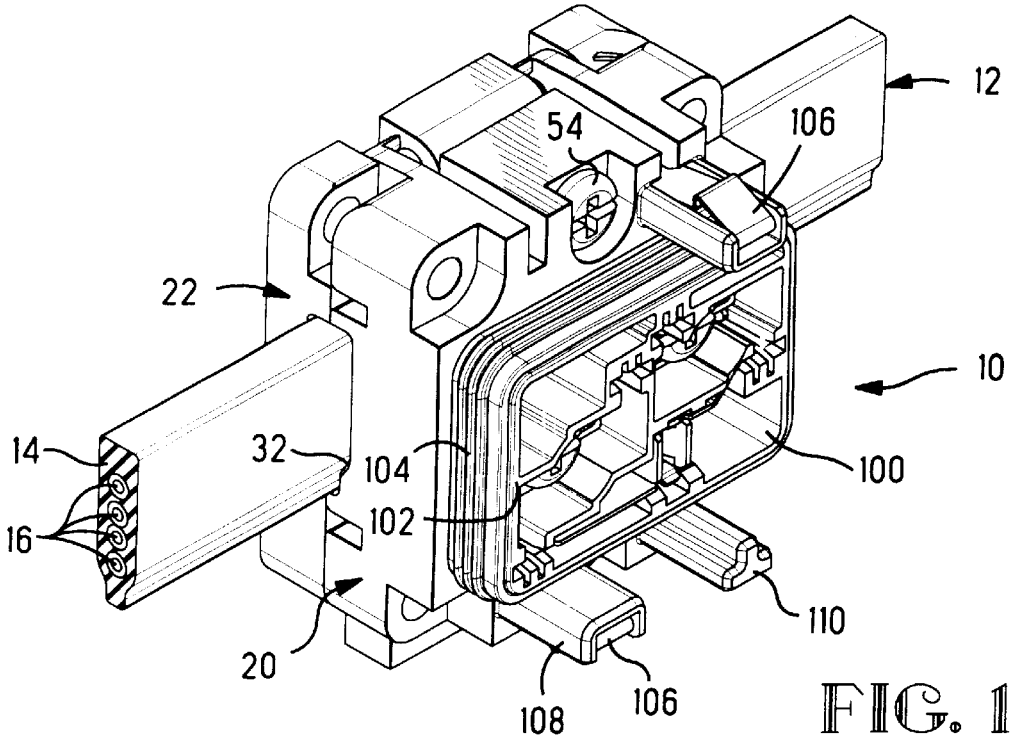
FIG. 1 is an isometric view of a first embodiment of the connector terminated to a cable.

Cable tap connector 10 of FIGS. 1 to 7 is terminated to a cable 12 having an outer jacket 14 and, for example, four conductors 16. Connector 10 includes an insulative housing 20 and a second insulative member, cover 22 to which it is securable to surround cable 12 at a location remote from an end of the cable, as well as at a cable end. Housing 20 and cover 22 include shallow wide grooves 24,26 along assembly faces 28,30 thereof together defining cable-receiving channel or nest 32 that will clamp about the cable. The cable cross-section is shown to include a reduced thickness flange along one side, serving to polarize the orientation of the cable tap connector with respect to the cable, its cable-receiving channel being complementarily shaped, thus assuring that the power conductors and signal conductors are positioned appropriately for termination to the appropriate contact members of the connector. Gaskets 34,36 such as of elastomeric material may be affixed to assembly faces 28,30 to seal the termination region after termination, from moisture, dust and gasses of the outside environment; alternatively, sheets of mastic material may be used for sealing.

Figure 2:
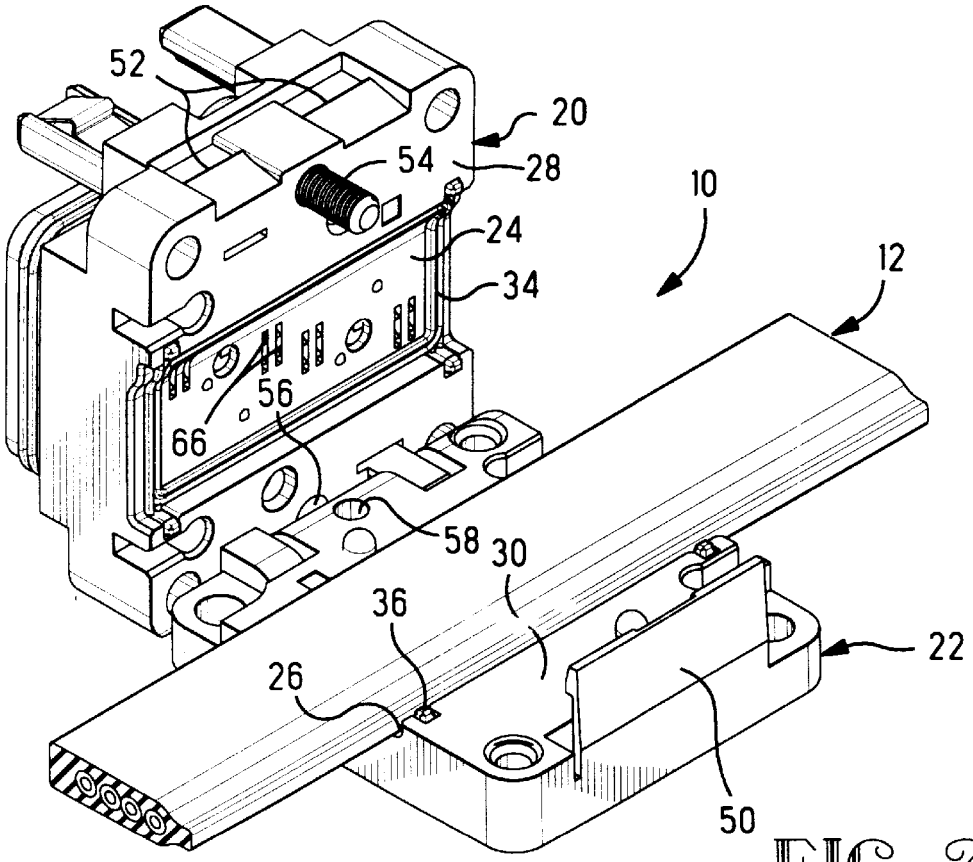
FIG. 2 is an isometric view of the connector of FIG. 1 with a cable nested therein, with the contacts recessed prior to termination.
Figure 5:
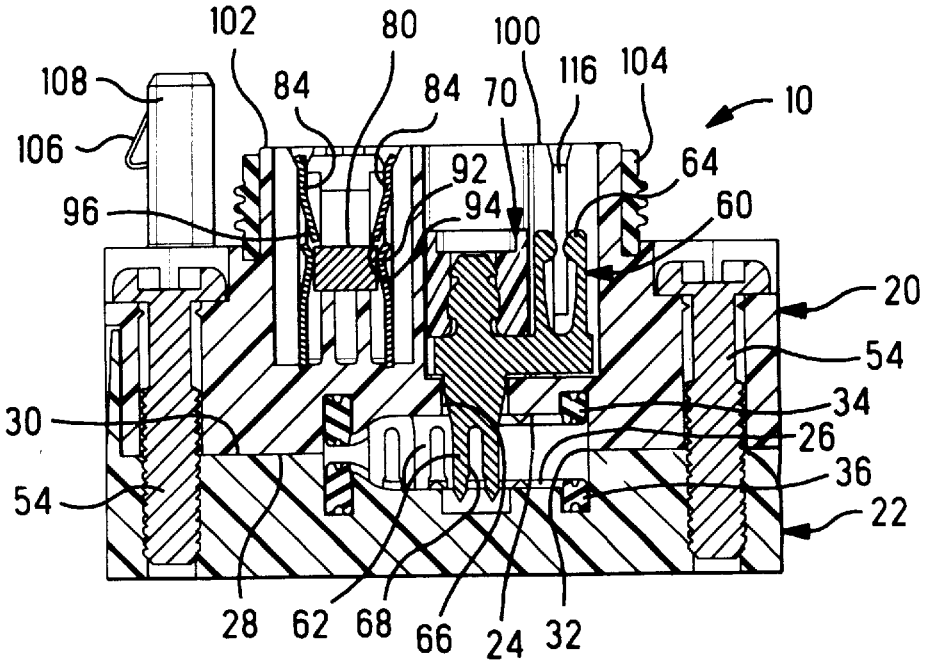
FIG. 5 is a cross-sectional view of the cable tap connector of FIG. 4 taken along lines 5—5 thereof.

Referring to FIGS. 1, 2 and 5, housing 20 and cover 22 are securable to each other about cable 12; preferably, housing 20 and cover 22 are hingedly joined to each other, to be rotated or pivoted together for assembly faces 28,30 to meet about the cable for grooves 24,26 to form cable-receiving channel 32. Upon closure about cable 12, a latch arm 50 of cover 22 latches to housing 20 at latching ledges 52. Then, fasteners 54 are insertable through holes 56 of housing 20 to thread into apertures 58 of cover 22 to complete securing the housing to the cover prior to cable termination. Connector 10 may be mounted to a panel, or a bracket may be secured to cover 22 to enable clamping to a DIN rail, as is disclosed in pending U.S. patent application Ser. No. 09/056,083 filed Apr. 7, 1998 now U.S. Pat. No. 6,022,240 and assigned to the assignee hereof.

Figure 3:
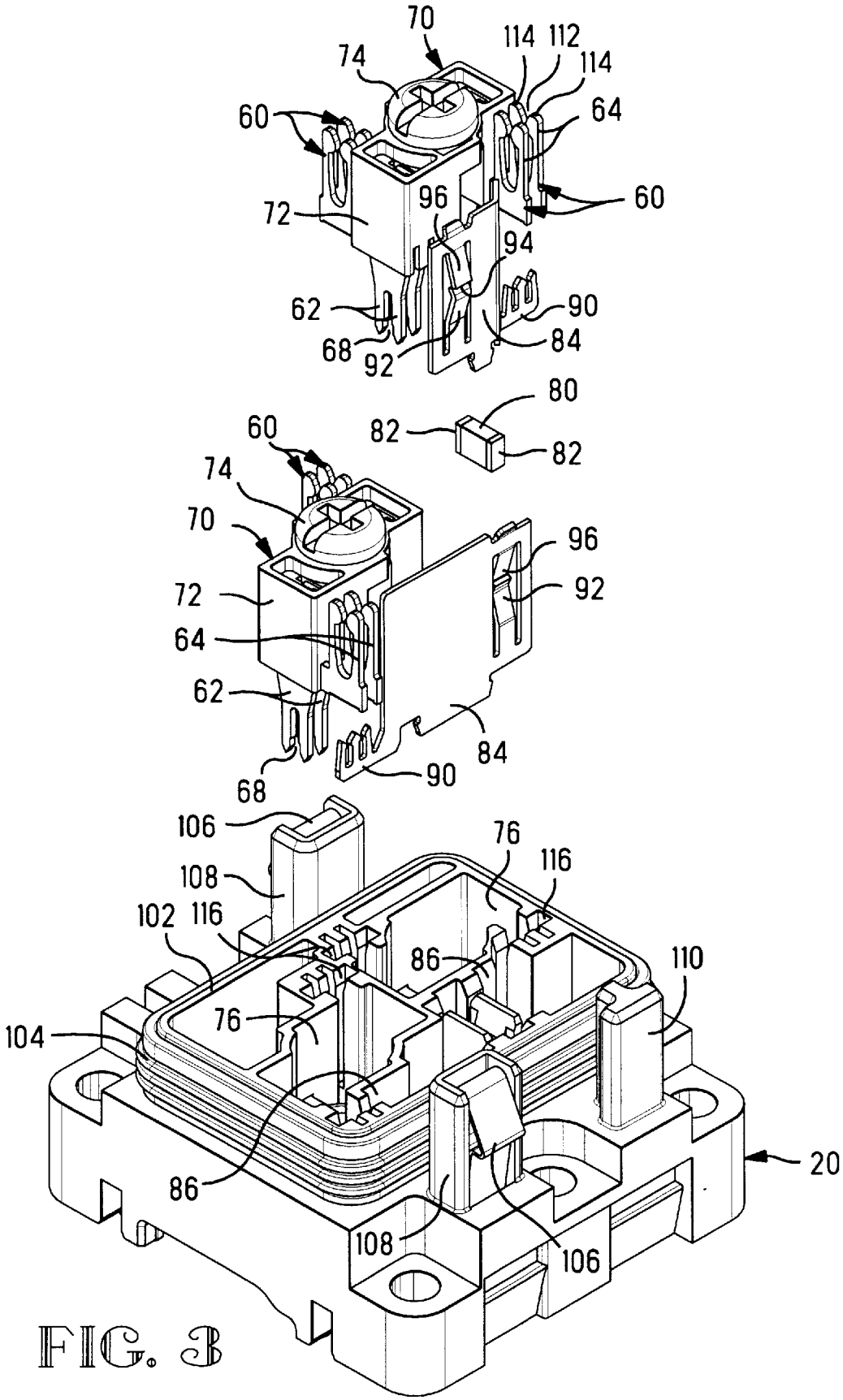
FIG. 3 is an isometric view of the upper housing of the connector of FIGS. 1 to 4 with the terminal subassemblies, a chip capacitor, and a pair of capacitor-engaging contacts exploded therefrom.
Figure 4:
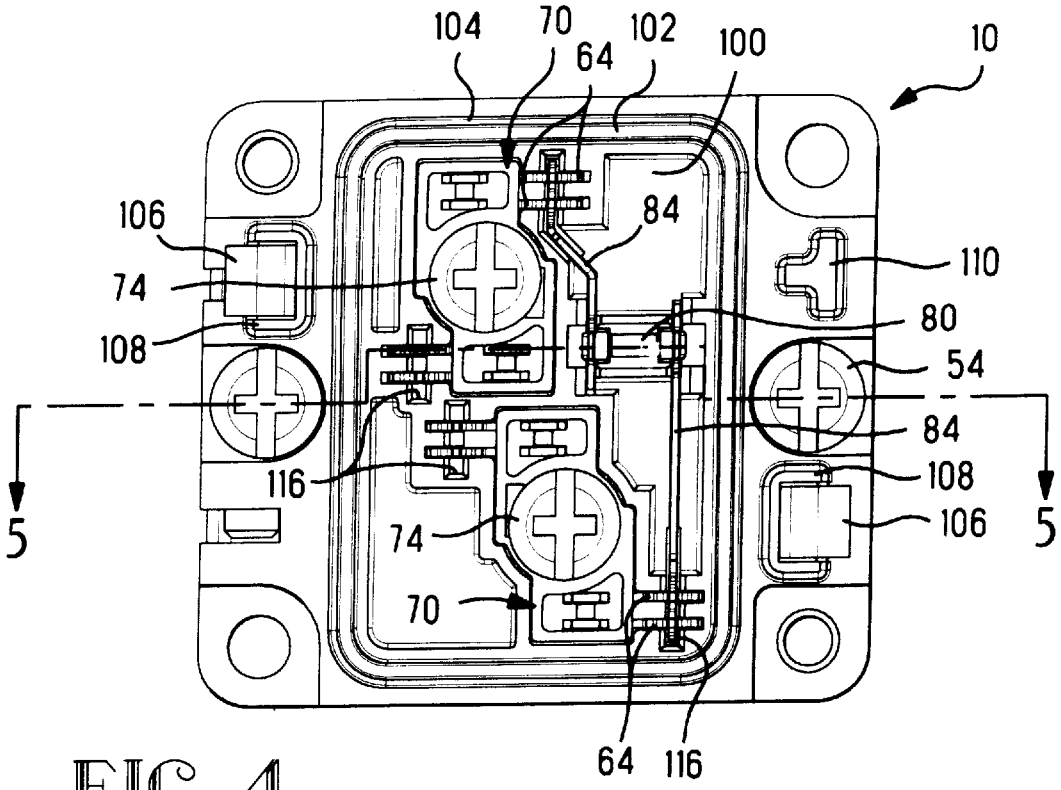
FIG. 4 is a plan view of the connector of FIGS. 1 to 3 along the mating interface.

Now referring to FIGS. 3 to 5, connector 10 includes a plurality of contacts 60, associated in pairs with respective conductors 16 of cable 12 and having insulation displacement (IDC) or first contact sections 62 that will compressively engage conductors 16 upon termination, after connector 10 is assembled around the cable. The provision of a pair of contacts engaging each conductor increases the current-carrying capacity of the connector, with attendant advantages of substantially reduced heat generation and related temperature rise and substantially reduced losses, as well as redundancy. Contacts 60 also have second contact sections 64 exposed along mating face 100 of housing 20 after assembly and termination, for electrical connection with complementary contacts of an interface connector module (FIGS. 6 to 15). Second contact sections 64 are shown to be of the tuning fork type adapted to receive blade-shaped contact sections of contacts of an interface module in slots 112 thereof between resilient beams 114, as is known. Preferably, second contact sections 64 are recessed within H-shaped blade-receiving slots 116 defined by insulative housing 20 along mating face 100, with the H-shaped blade-receiving slots assuring that the blade-shaped contact sections of the interface module are aligned properly to enter the slots 112 of the tuning fork contact sections.

Contacts 60 are first secured in two pairs within insulative carriers 72, seen best in FIGS. 2 and 5, to define terminal subassemblies 70 that also include actuators 74, and are secured therein by retention legs force fit into openings of insulative carriers 72 (see FIG. 5). The subassemblies 70 are then secured in respective cavities 76 in mating face 100 of housing 20 such that IDC contact sections 62 are disposed within respective slots 66 of housing 20 that extend from mating face 100 to cable face 28. Initially, IDC contact sections 62 are recessed completely within slots 66 of housing 20 until after connector 10 is secured around cable 12, whereafter actuation of actuators 74 moves the contacts 60 toward the cable, when IDC contact sections 62 penetrate insulative jacket 14 of the cable and receive into their IDC slots 68, the respective conductors 16 under assured compression to establish electrical connections therewith. Cable 12 has been omitted in FIG. 5 to reveal the IDC contact sections after actuation of actuators 74.

Also seen in FIGS. 3 to 5 is a chip capacitor 80 held in the connector by a pair of capacitor-engaging terminals 84 that are affixable to housing 20 along mating face 100 within respective slots 86. The capacitor-engaging terminals 84 include contact sections 90 to establish an electrical connection with one pair of contacts 60 of respective subassemblies 70 upon assembly of connector 10, in order to be connected in parallel to power circuits when the one pair of contacts 60 becomes electrically connected with a power conductor of the cable. Each capacitor-engaging terminal 84 also includes a capacitor-engaging section having a spring arm 92 that engages an associated electrode 82 of the capacitor, and a retention ledge 94 that secures the capacitor 80 in the housing as seen in FIG. 5.

Figure 7:
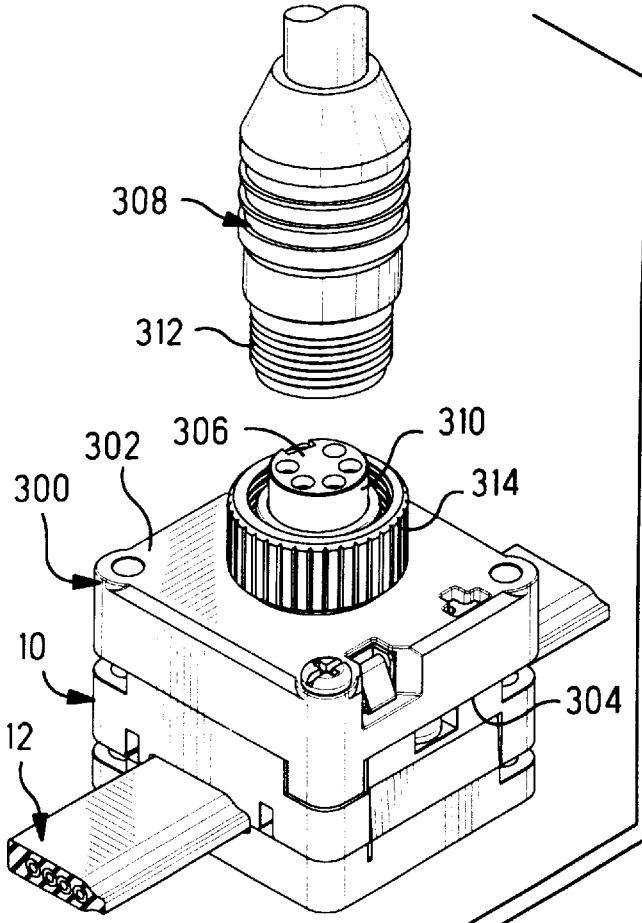
FIG. 7 is an isometric view of a second interface module matable to a round cable connector along the second mating interface.
Figure 6:
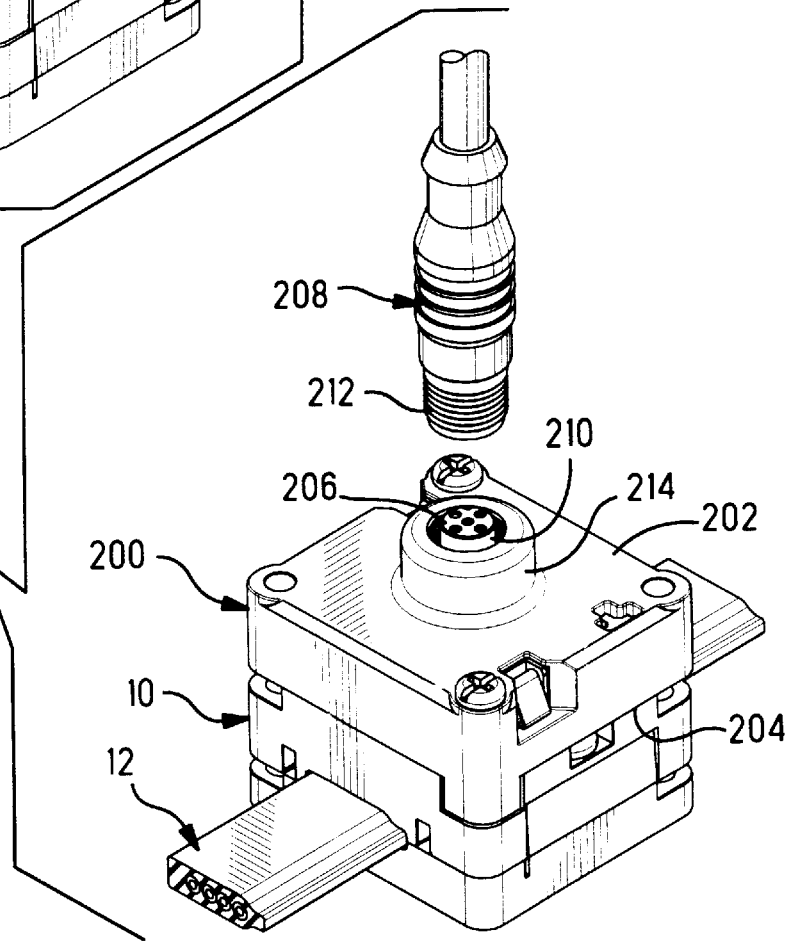
FIG. 6 is an isometric view of a first interface module of the present invention matable to a miniature round cable connector along the second mating interface.

Mating face 100 is seen to include a sealing gasket 104 of elastomeric material surrounding a shroud 102 to seal the mating interface when an interface module such as module 200 or 300 becomes mated to connector 10, as seen in FIGS. 6 and 7. Mating face 100 also preferably includes a pair of latch members 106 along opposed sides of shroud 102 to provide latching retention of an interface module upon mating. Latch members 106 are seen to be recessed within silos 108 extending from housing 20 outside of shroud 102, to provide protection for latch members 106. Silos 108 may also serve as alignment members. Additionally, connector 10 preferably includes polarization features at mating face 100, such as T-shaped key projection 110 extending upwardly from housing 20 outside of shroud 102, to assure that an interface module is appropriately oriented prior to mating of the contacts thereof with second contact sections 64 of respective pairs of contact members 60 of connector 10.

The interface modules of FIGS. 6 and 7 contain the contact array of the present invention, that is discussed hereinbelow with reference to FIGS. 9 to 15, and also are disclosed in greater detail in U.S. patent application Ser. No. 09,170,631 filed Oct. 13, 1998 (concurrently herewith) and assigned to the assignee hereof.

In FIG. 6 is shown a first interface module 200 illustrated in mated relationship to cable tap connector 10 and having an insulative housing 202 with a first mating interface 204 and second mating interface 206. First mating interface 204 is adapted to mate with mating face 100 of cable tap connector 10, while second mating interface 206 is adapted to mate with a miniature round cable connector 208. Module 200 at second mating interface 206 includes a cylindrical plug portion 210 for receipt into a plug-receiving cavity of connector 208 defined by a shroud within a freely rotatable coupling ring 212. An annular embossment 214 surrounds cylindrical plug portion 210 and is spaced therefrom with its inner surface being threaded. The outer surface of coupling ring 212 is threaded so that after mating of connector 208 and module 200, rotation of the coupling ring around connector 208 results in threaded engagement with embossment 214 to assuredly secure the connector 208 and module 200 in mated engagement.

Referring now to FIG. 7, a second interface module 300 is illustrated in mated relationship to cable tap connector 10 and having an insulative housing 302, a first mating interface 304 and a second mating interface 306. First mating interface 304 is identical to that of module 200, while second mating interface 306 is adapted to mate with a round cable connector 308 that is of a larger diameter than miniature round cable connector 208 of FIG. 6. Similar to module 200, second interface module 300 includes a cylindrical plug portion 310 for receipt into a plug-receiving cavity of connector 308 defined within shroud 312, and the outer surface of shroud 312 is threaded. Coupling ring 314 is secured to module 300 by a retention clip 316 (see FIG. 9) in a manner permitting free rotation thereof to become threaded onto shroud 312 of connector 308 after its mating with module 300; an O-ring 318 is also preferably positioned within coupling ring 314 for sealing.

In both FIGS. 6 and 7 a fifth passageway in the second mating interfaces of both modules receives a pin contact of the mating connector; a ground contact (not shown) may be utilized in the fifth passageway for grounding.

Figure 8:
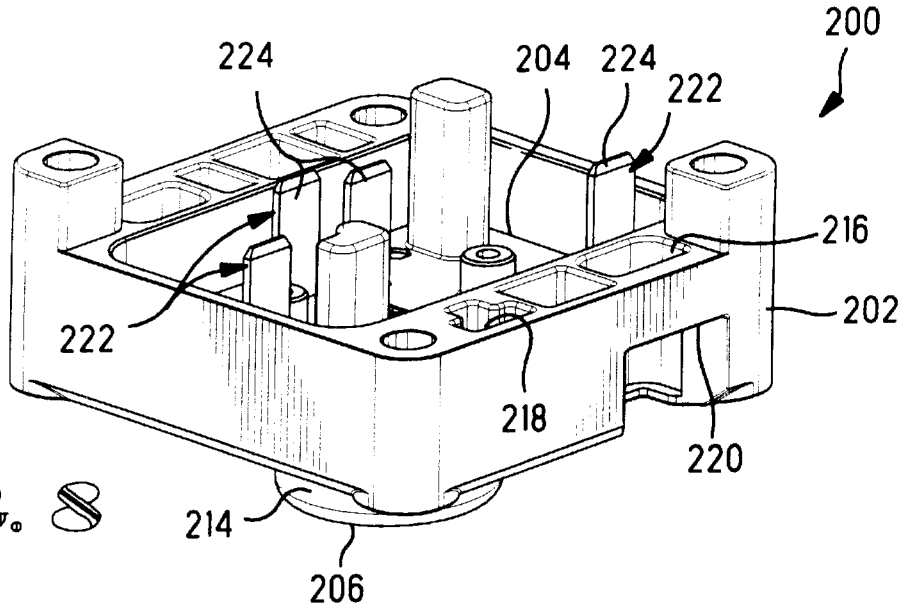
FIG. 8 is an isometric view of the mating interface of a mating connector matable with the connector of FIGS. 1 to 5.

First mating interface 204 of module 200 is illustrated in FIG. 8. Silo-receiving apertures 216 and key-receiving channel 218 are associated with silos 108 and key projection 110 of cable tap connector 10 (FIGS. 1 and 3), and latching surfaces 220 become latchingly engaged by latches 106 upon connector/module mating. Contact assemblies 222 of module 200 (four in number in the present embodiment) include blade-shaped first contact sections 224 that enter into slots 116 and mate with tuning fork contact sections 64 of the cable tap connector (FIG. 5). Contact assemblies 222 are secured in module 200 by an insulative retention plate (see FIG. 9) secured to housing 202.

Figure 9:
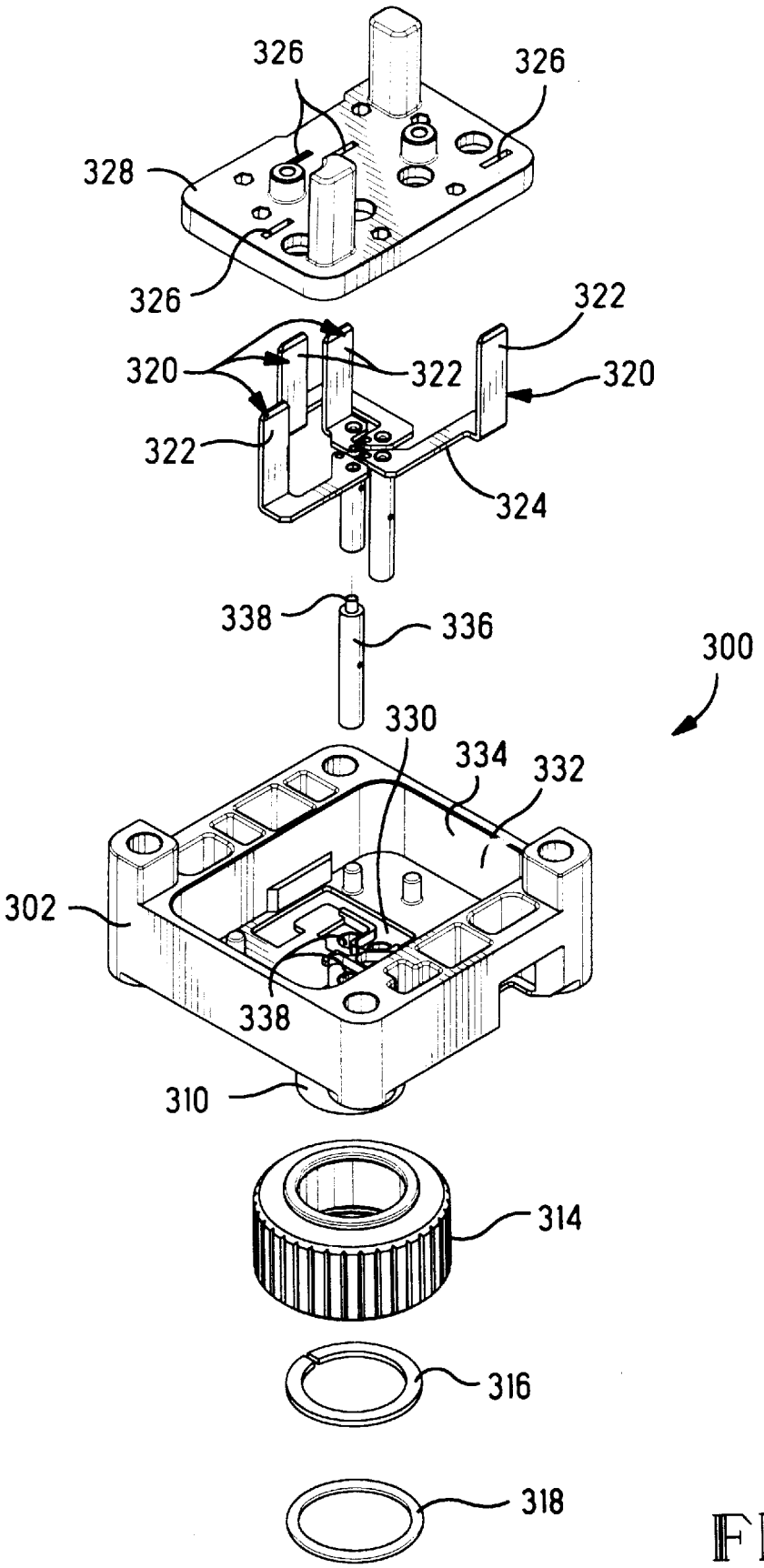
FIG. 9 is an exploded view of the second interface module of FIG. 7.

Modules 200 and 300 are similarly constructed, with their contact assemblies secured in the same manner by insulative retention plates, and their first mating interfaces 204,304 are identical to enable mating of either one with cable tap connector 10. In FIG. 9 assembly of module 300 is shown. Contact assemblies 320 have blade-shaped first contact sections 322 extending from transverse planar body sections 324, through slots 326 of insulative retention plate 328 to be exposed along first mating interface 304, and body sections 324 are seated within shallow recesses 330 of housing 302. The first contact sections are disposed within large cavity 332 into which is received shroud 102 of cable tap connector 10 upon mating, with gasket 104 to seal against side walls 334 of large cavity 332. Second contact sections 336 extend from body sections 324 and will be disposed in passageways 338 of housing 302 to be adjacent second mating interface 306. The first and second contact sections extend axially from opposed ends of transverse body section 324, offset from each other to correlate with the different mating interfaces.

Figure 10:
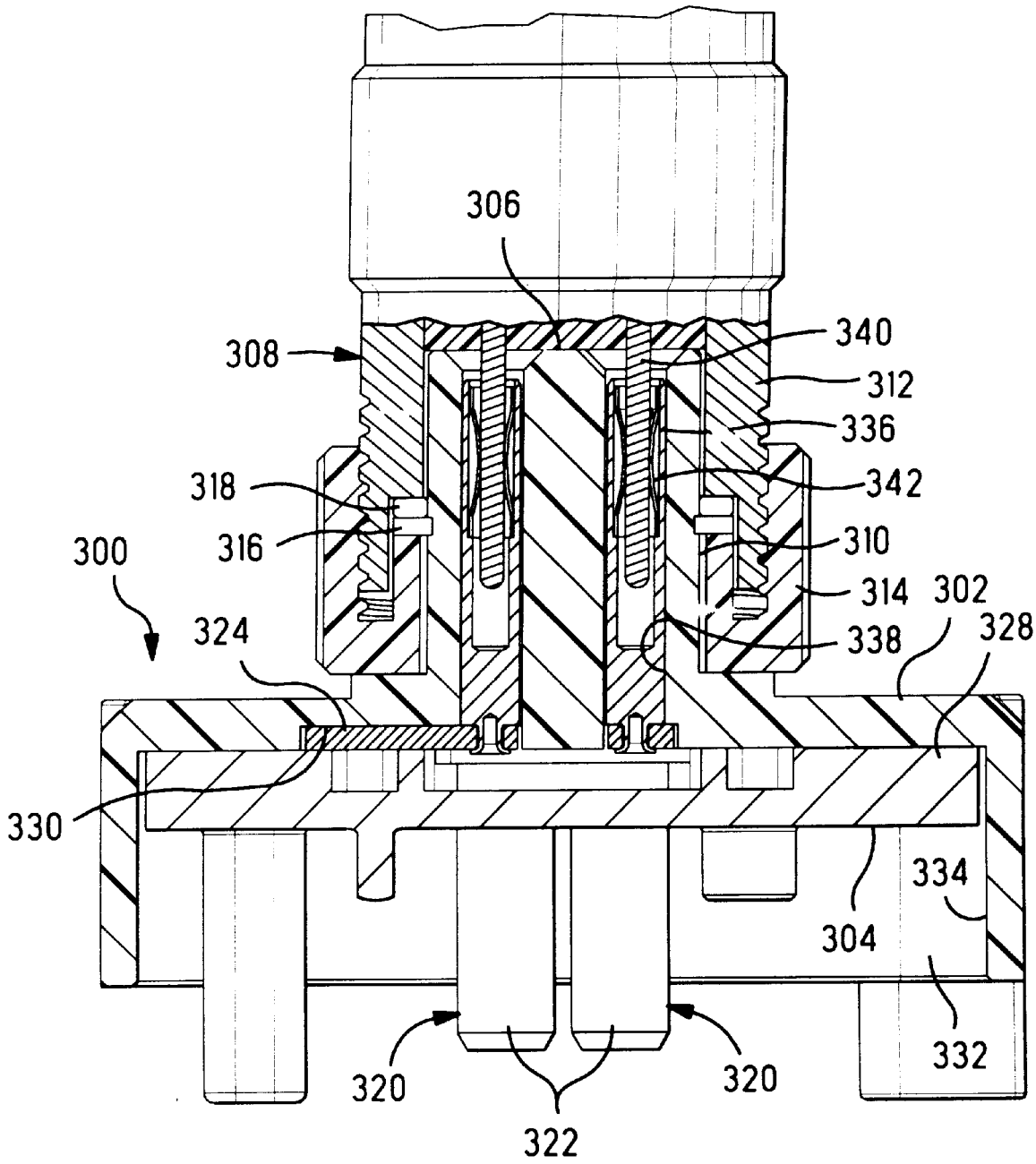
FIG. 10 is a cross-sectional view of the second mating interface module of FIG. 7 mated with a miniature round cable connector.
Figure 11:
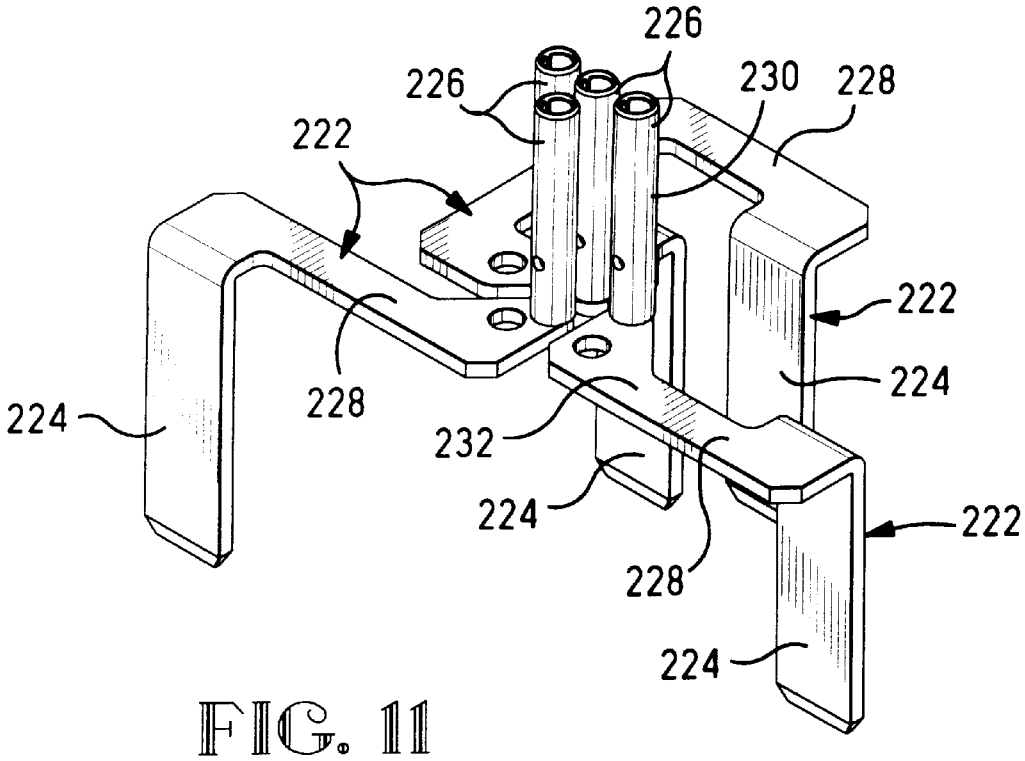
FIGS. 11 and 12 isometric views of the terminals of the interface module of FIG. 6.
Figure 12:
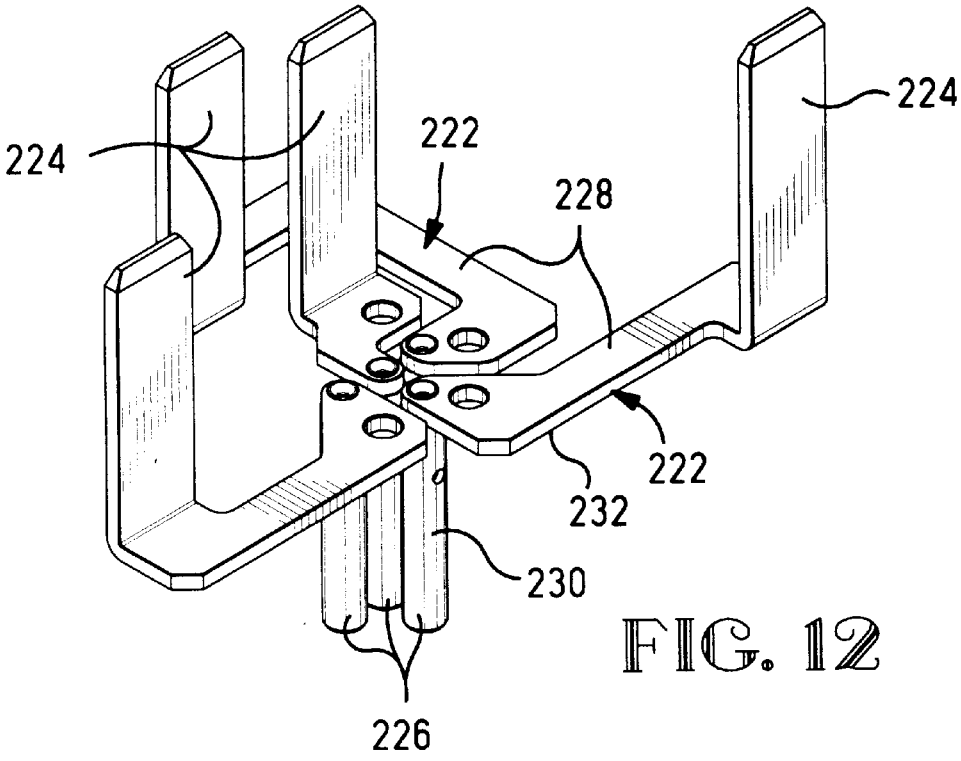

In FIG. 10, second interface module 300 is shown mated to round cable connector 308, and coupling ring 314 has been threaded onto shroud 312. Plug portion 310 has been received into shroud 312, and pin contact sections 340 of the contacts of connector 308 have been received into second contact sections 336, shown to be sockets having spring beams 342 establishing assured electrical engagement therebetween. Transverse body sections are shown seated in recesses 330, and second contact sections 336 are shown joined to transverse body sections 324 of contact assemblies 320.

Contact assemblies useful with either first interface module 200 of FIGS. 6 and 8 or second interface module 300 of FIGS. 7 and 9, result from the contact array of the present invention, that will now be described with particular reference to FIGS. 11 to 15 in which the numbering will correspond to contact assemblies for first interface module 200.

Contact assemblies 222 show second contact sections 226 extending from transverse body sections 228, in which second contact sections are discrete second members 230 while discrete unitary first members 232 include first contact sections 224 extending from body sections 228. As is seen from FIG. 13 (and FIG. 10), second members 230 include a spring element 234 containing several spring beams 236 disposed in friction fit within pin-receiving aperture 238 of socket member 240. An initially cylindrical embossment 242 extends from end 244 of socket member 240.

Each transverse body section 228 of each contact assembly 222 extends from first contact section 224 to an interconnection portion 246 having a first smaller diameter hole 248 therethrough and a second larger diameter hole 250 therethrough. Smaller diameter holes 248 of the several interconnection portions 246 are positioned near the adjacent ends 252 thereof to define a closely spaced array, while larger diameter holes 250 being farther from adjacent ends 252 of interconnection portions 246 to define a less closely spaced array. Second member 230 is joined to first member 232 at the interconnection portion 246, with all interconnection portions 246 located centrally in the array so that the second members coextend from smaller diameter holes 248 thereof in a closely gathered array (circle 254 of FIG. 15) corresponding to the requisite locations of second mating interface 206 of FIG. 6 to enable mating with pin contacts of miniature round cable connector 208. Second contact sections 336 of contact assemblies 320 of FIGS. 7 and 9 are larger than second contact sections 226 and have larger embossments 358 for being joined to first members 232 at larger holes 250, to produce a less closely spaced array (circle 256 of FIG. 15) appropriate for the second mating interface corresponding to round cable connector 308.

As shown in FIG. 14, initially cylindrical embossments 242 of second members 230 are first inserted into smaller diameter holes 248 of interconnection portions 246, with an annular flanged end 258 extending therebeyond. Tool 260 is then utilized having a work end 262 shaped to deform end 258 of embossment 242 upon striking it, rolling it outwardly over the periphery of hole 248, in rivet-like fashion. Alternatively, force fitting methods may be utilized. The housing of the interface module may be used as a holder during joining of first and second members of the contact assemblies. The same joining technique may be used with embossments 358 of second contact sections 336 in larger diameter hole 250, to form contact assemblies 320 of module 300.

Figure 15:
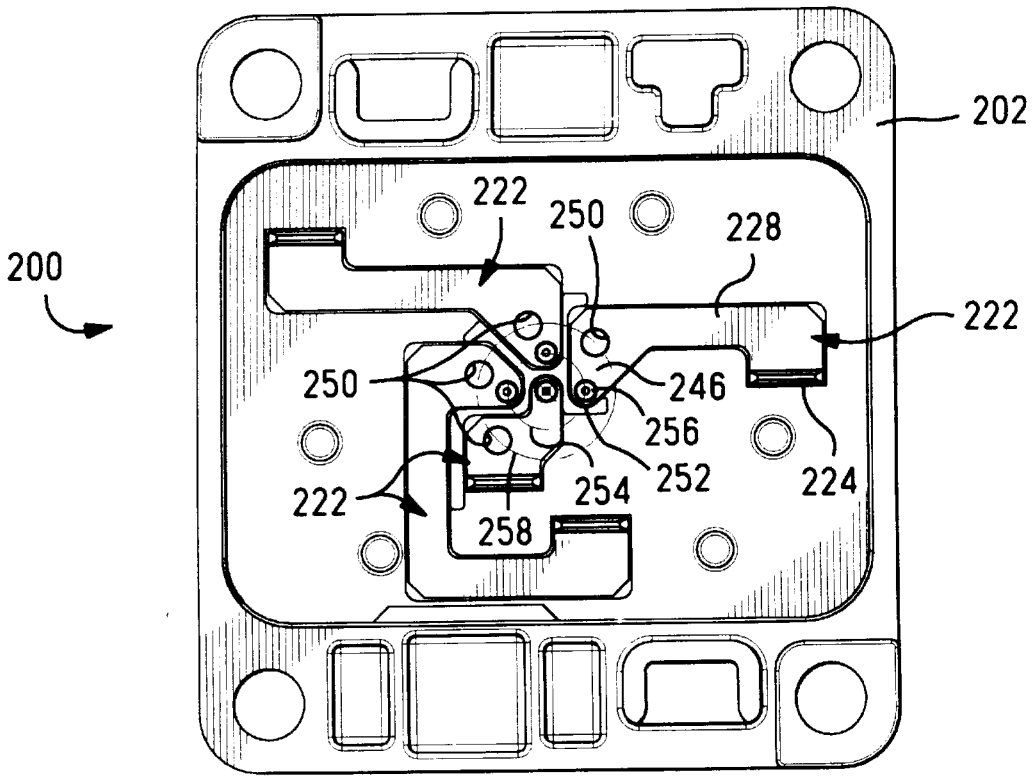
FIG. 15 is a plan view of the connectors of either of FIGS. 6 or 7 with the terminals disposed along the first mating interface of the module housing prior to affixing of the alignment plate thereover.

Thus the same first members 232 may be used with different second contact sections 226 or 336, simply by choosing an appropriate one of smaller diameter holes 248 or larger diameter holes 250 to fabricate contact assemblies 222 for first interface module 200 or contact assemblies 320 for second interface module 300. FIG. 15 shows contact assemblies 222 positioned in housing 202 of module 200 prior to securing the insulative retention plate thereon, with second contact sections disposed within passageways of the housing, to illustrate the closely spaced array indicated by flanges 258 at smaller diameter holes by circle 254, while the less closely spaced array (circle 256) is indicated by larger diameter holes 250.

Other variations and modifications of the present invention may be devised that are within the spirit of the invention and the scope of the claims.

What is claimed is:

1. An electrical connector comprising:

an insulative housing having a first mating face adapted to be mated to a first complementary connector, a second mating face adapted to be mated to a second complementary connector, and a contact assembly comprising a plurality of adjustable contacts securable in the housing;

each said contact having a first and a second member, the first member including a connector mating portion exposed along the first mating face and a substantially planar body section, the first member connector mating portion joined to a first end of the planar body section, the second member including a connector mating portion exposed along the second mating face at a first end thereof and a joining element at a second end thereof; and the body section having at least two joining elements at a second end thereof, each said body section joining element adapted to cooperate with the second member joining element enabling said second member to be joined at a selected one of said at least two body section joining elements, each of the at least two body section joining elements having a unique position on the body section, correspondingly uniquely positioned body section joining elements of each of the plurality of contacts forming a distinct array of joining elements.

2. A contact assembly comprising:

a plurality of adjustable contacts, each of,the contacts comprising a planar body portion, a first contact member and a second contact member, the first contact member integrally formed with and extending perpendicularly from a first end of the body portion, the body portion including a coupling section at a second end, and the second contact member including a coupling section at a first end adapted for coupling with the body portion coupling section, and the body portion coupling section comprising at least two through holes, one of the at least two through holes of each of the plurality of contacts being an element of a distinct array of through holes.

3. A contact assembly comprising:

a plurality of adjustable contacts, each said contact having a first and a second member, the first member including a connector mating portion exposed along the first mating face and a substantially planar body section, the first member connector mating portion joined to a first end of the planar body section, the second member including a connector mating portion exposed along the second mating face at a first end thereof and a joining element at a second end thereof, the body section having at least two joining elements at a second end thereof, each said body section joining element adapted to cooperate with the second member joining element enabling said second member to be joined at a selected one of said at least two body section joining elements, and each of the at least two body section joining elements having a unique position on the body section, correspondingly uniquely positioned body section joining elements of each of the plurality of contacts forming a distinct array of joining elements.

* * * * *